US006007270A

United States Patent [19]

Bowman

[11] Patent Number: 6,007,270

[45] **Date of Patent: *Dec. 28, 1999**

[54] MANHOLE FRAME ASSEMBLY

[76] Inventor: Harold M. Bowman, 18867 North Valley Dr., Fairvew Park, Ohio 44126

[ * ] Notice: This patent is subject to a terminal disclaimer.

[21] Appl. No.: 08/854,964

[22] Filed: May 12, 1997

Related U.S. Application Data

[63] Continuation-in-part of application No. 08/515,986, Aug. 16, 1995, Pat. No. 5,628,152, and a continuation-in-part of application No. 08/517,081, Aug. 21, 1995, Pat. No. 5,697,729, which is a continuation of application No. 08/242,015, May 12, 1994, abandoned, which is a continuation-in-part of application No. 08/087,171, Jul. 2, 1993, abandoned.

[51] Int. Cl.[6] ..... E02D 29/14

[52] U.S. Cl. ..... 404/25; 404/26

[58] Field of Search ..... 52/19, 20, 21; 404/25, 26; 137/364, 371; 210/163, 165; D23/261

[56] References Cited

U.S. PATENT DOCUMENTS

| | | |
|---|---|---|
| Re. 34,550 | 2/1994 | Bowman . |
| D. 247,254 | 2/1978 | Brown et al. . |
| 599,457 | 2/1898 | Sanborn . |
| 911,256 | 2/1909 | McWane . |
| 922,892 | 5/1909 | Harrington . |
| 953,858 | 4/1910 | Pendergast . |
| 1,001,041 | 8/1911 | Jones . |
| 1,016,081 | 1/1912 | McNulty . |
| 1,071,577 | 8/1913 | Rego . |
| 1,073,150 | 9/1913 | Linskie . |
| 1,102,422 | 7/1914 | McKeon . |
| 1,131,327 | 3/1915 | Caldwell . |
| 1,152,618 | 9/1915 | Farris . |
| 1,163,189 | 12/1915 | Wolf . |
| 1,177,850 | 4/1916 | Dougherty . |
| 1,191,431 | 7/1916 | Jones . |

(List continued on next page.)

FOREIGN PATENT DOCUMENTS

| | | |
|---|---|---|
| 483018 | 5/1952 | Canada . |
| 1965515 | 7/1969 | Germany . |
| 336437 | 11/1930 | United Kingdom . |
| 2066335 | 7/1981 | United Kingdom . |
| 2088446 | 6/1982 | United Kingdom . |

OTHER PUBLICATIONS

Drawing from New York State's Department of Transportation, date unknown.

P.C. Perdikaris, P.E., Ph.D., Technical Civil Engineering report, Mar. 15, 1988.

Japanese publication entitled "Reinforced Concrete Manhole Blocks for Sewerage Work", by Japanese Standards Association.

(List continued on next page.)

*Primary Examiner*—James A. Lisehora
*Attorney, Agent, or Firm*—Watts, Hoffmann, Fisher & Heinke, Co., L.P.A.

[57] ABSTRACT

A manhole frame assembly for supporting a member that can obstruct an access opening when the level of a construction material around the opening is raised, includes an outer frame member having a support surface and a side wall extending from the support surface. The side wall is constructed and arranged with an upper surface that is substantially flush with an original level of the construction material. An inner frame member can be received on the support surface and includes a surface for supporting a member for obstructing the access opening. The side wall includes an abutment device for preventing upward movement of the inner frame member when the original level of construction material around the outer frame member is raised. A portion of the inner frame member is movable in a direction transverse to a direction of a length of the access opening. Other features of the invention are directed to a method of fastening the inner frame to the outer frame and an apparatus for fastening the obstructing member to a manhole frame structure.

26 Claims, 5 Drawing Sheets

U.S. PATENT DOCUMENTS 1,191,432 7/1916 Jones .
1,191,497 7/1916 Dauphinee .
1,287,290 12/1918 Golden .
1,384,712 7/1921 Shanley .
1,388,492 8/1921 Thomsen .
1,400,399 12/1921 Yaeche .
1,417,377 5/1922 Gschwind .
1,542,900 6/1925 Maddocks .
1,580,541 4/1926 Sherman .
1,602,713 10/1926 Shanley .
1,610,123 12/1926 Fairweather .
1,639,495 8/1927 Frame .
1,683,365 9/1928 Loudenslager et al. .
1,693,190 11/1928 Benedetti .
1,717,364 6/1929 Borland .
1,721,831 7/1929 Porter .
1,892,830 1/1933 Dougherty .
1,898,871 2/1933 Ellis .
1,908,909 5/1933 Manz .
1,926,595 9/1933 Mulvihill .
1,959,171 5/1934 Mayer .
1,962,881 6/1934 Shanley .
1,988,360 1/1935 Moore .
1,990,909 2/1935 Lambert .
2,009,132 7/1935 Gehris .
2,051,172 8/1936 Kramer .
2,109,287 2/1938 Elkington .
2,113,713 4/1938 Slocum .
2,114,499 4/1938 Maclear .
2,328,068 8/1943 Harris .
2,346,361 4/1944 Cupido .
2,535,275 12/1950 Dixon .
2,593,918 4/1952 Redman .
2,661,863 12/1953 Howe .
2,682,211 6/1954 Avila .
2,697,389 12/1954 Heckman .
2,817,274 12/1957 Benoit .
2,903,875 9/1959 Bonatz et al. .
3,217,619 11/1965 Driver et al. .
3,218,943 11/1965 Bowman .
3,308,727 3/1967 Hurt, Jr. .
3,326,100 6/1967 White .
3,385,011 5/1968 Sorrell .
3,408,778 11/1968 Mason .
3,426,659 2/1969 Clarke et al. .
3,490,177 1/1970 Perrion .
3,533,199 10/1970 Pickett .
3,568,746 3/1971 Faroni et al. .
3,629,981 12/1971 McCaffery .
3,773,428 11/1973 Bowman .
3,858,998 1/1975 Larason et al. .
3,891,337 6/1975 McCoy .
3,911,635 10/1975 Traupe .
3,920,347 11/1975 Sauriol et al. .
3,921,494 11/1975 Coe .
3,926,533 12/1975 Binette .
3,930,739 1/1976 Larsson et al. .
3,945,746 3/1976 Bredbenner .
3,968,600 7/1976 Bowman .
3,969,847 7/1976 Campagna et al. .
3,973,856 8/1976 Gaglioti .
3,975,870 8/1976 Naka .
3,977,124 8/1976 Oger .
4,000,953 1/1977 Langeliers et al. .
4,015,373 4/1977 Boissier .
4,029,425 6/1977 Pelsue .
4,030,851 6/1977 Graybeal .
4,038,789 8/1977 Axgarde et al. .
4,061,434 12/1977 Carroll .
4,067,659 1/1978 Campagna, Jr. et al. .
4,075,796 2/1978 Cuozzo .
4,089,139 5/1978 Moffa et al. .
4,097,171 6/1978 Fier .
4,097,228 6/1978 Rosling .
4,123,184 10/1978 Whitlock .
4,145,151 3/1979 Helms .
4,187,647 2/1980 Hall .
4,188,151 2/1980 Hall .
4,197,031 4/1980 Hild .
4,203,686 5/1980 Bowman .
4,225,266 9/1980 Fier .
4,236,358 12/1980 Bowman .
4,269,385 5/1981 Bowman .
4,273,467 6/1981 Cronk .
4,281,944 8/1981 Bowman .
4,302,126 11/1981 Fier .
4,358,084 11/1982 Bowman .
4,416,440 11/1983 Bowman et al. .
4,440,407 4/1984 Gagas .
4,544,302 10/1985 Farrelly .
4,582,449 4/1986 Vosswinkel .
4,582,450 4/1986 Neil .
4,637,752 1/1987 Centa .
4,648,740 3/1987 Carlson .
4,650,365 3/1987 Runnels .
4,657,752 4/1987 Lyon .
4,673,310 6/1987 LeBaron .
4,690,584 9/1987 LeBaron .
4,706,718 11/1987 Milo .
4,747,739 5/1988 Bowman et al. .
4,763,444 8/1988 Ritchie .
4,763,449 8/1988 Vigneron et al. .
4,834,574 5/1989 Bowman .
4,867,600 9/1989 Bowman .
4,867,601 9/1989 Bowman .
4,872,780 10/1989 Bowman .
4,927,290 5/1990 Bowman .
4,963,053 10/1990 Bowman .
4,966,489 10/1990 Bowman .
4,969,770 11/1990 Bowman .
4,969,771 11/1990 Bowman .
4,976,568 12/1990 Hess .
5,021,261 6/1991 Bowman .
5,039,248 8/1991 Bowman .
5,051,022 9/1991 Bowman .
5,143,478 9/1992 Bowman .
5,150,984 9/1992 Bowman et al. .
5,165,819 11/1992 Bowman .
5,184,912 2/1993 Bowman et al. .
5,201,151 4/1993 LeBlanc et al. .
5,303,518 4/1994 Strickland .
5,308,189 5/1994 Claing .
5,326,188 7/1994 Bowman .
5,344,253 9/1994 Sacchetti .
5,366,317 11/1994 Solimar .
5,383,311 1/1995 Strickland .
5,401,114 3/1995 Guggemos .
5,431,553 7/1995 Topf, Jr. .
5,628,152 5/1997 Bowman .
5,697,729 12/1997 Bowman ..... 404/25

OTHER PUBLICATIONS

Japanese publication entitled "Manhole Cover for Sewerage", by Japanese Standards Association, published 1987.

NUPCO brochure, "Adjus–to Grade With Safe–Tite–Seal", copyright 1989.

NUPCO brochure, "Adjust–to–Grade Manhole Castings", Date Unknown.

Drawing from New York State's Department of Transportation, published before Aug. 16, 1994.

Specification sheets and drawings from Taiwanese distributor, 4 pages, date unknown.

Grate Locking Device brochure, published before Aug. 16, 1994. Author unknown.

MANHOLE FRAME ASSEMBLY

RELATED APPLICATION

This application is a continuation-in-part of U.S. patent application Ser. No. 08/515,986, filed Aug. 16, 1995, now U.S. Pat. No. 5,628,152, entitled "ADJUSTABLE MANHOLE COVER SUPPORT WITH SHIELD," and a continuation-in-part of U.S. patent application Ser. No. 08/517,081, filed Aug. 21, 1995, now U.S. Pat. No. 5,697,729, entitled "ANCHOR FOR UTILITY ACCESS HOLE SUPPORT INSERT," which was a continuation of patent application Ser. No. 08/242,015, filed May 12, 1994, now abandoned, which was a continuation-in part of patent application Ser. No. 08/087,171, filed Jul. 2, 1993, now abandoned. All of the above applications all incorporated herein by reference in their entireties.

FIELD OF THE INVENTION

This invention relates to a manhole frame assembly and, in particular, to an inner frame member or insert received by an outer frame member for raising the level of a manhole cover, drainage grate or the like, especially upon resurfacing a roadway.

BACKGROUND OF THE INVENTION

Manhole frame assemblies located along a roadway typically include an outer frame that is disposed around an access opening which may lead, for example, to utility service distribution lines. A manhole cover, drainage grate or the like in the outer frame rests flush with the roadway surface. Ordinarily an inner frame in the form of a support insert is used in the outer frame when the roadway is resurfaced with an added layer of paving material. In the case of a manhole cover, for example, the support insert raises the level of the manhole cover to the new street level. Support inserts occupy the position where the manhole cover originally rested, typically on the rim of the outer frame.

Manhole frame assemblies may be provided with locking mechanisms to prevent unauthorized personnel from removing the cover, for example, and from removing the support insert from the outer frame. As shown in U.S. Pat. No. 4,969,770, the locking mechanisms for locking the support insert to the outer frame typically include fasteners which engage the underside of the rim. Workers may have difficulty securing the inner frame since they must reach under the rim to tighten the fasteners. Tools may be dropped into the access opening and lost in the process. Moreover, such fastening devices are only able to apply a limited force to the underside of the rim and to the insert.

Manhole frame and cover assemblies are currently unable to satisfactorily prevent "inflow", a combination of storm water and other street surface liquids, from entering the access opening. This inflow may consist of billions upon billions of gallons of excess street surface liquids. Once the inflow enters the manhole frame it gains entry into utility services such as sanitary sewer distribution lines, where it burdens wastewater treatment plants, and gas, electric or telecommunications underground vaults. The inflow is a problem because it mixes with the effluent in sanitary sewers, resulting in costly additional wastewater treatment.

An additional problem is presented when the inflow reaches other utility service areas normally found in gas, electric or telecommunications distribution lines. These service areas have concrete manhole casements that do not have an individual drainage system and thus, are partially or completely filled with inflow. Such installations often require extensive vacuum pumping to remove the inflow before workmen can safely enter the manhole to perform the required maintenance or other utility service.

Manhole frame assemblies are normally comprised of metal castings, generally produced by cast iron foundries, using sand casting molds. These casting methods are used to produce manhole components in cast ductile iron, grey cast iron, or the like. Castings made from these casting processes create difficulties in duplicating nearly exact castings as compared to the mold images. Non-uniform shrinkage, warpage, and the like promote dimensional instability that affects the fit between metal surfaces necessary to provide a water-tight condition.

SUMMARY OF THE INVENTION

The present invention relates to a manhole frame assembly that can support a member for obstructing a utility access opening such as a manhole cover, drainage grate or the like, which overcomes the aforementioned problems of the prior art. The present manhole frame assemblies are suitable for raising the level of the obstructing member to the level of a repaved roadway, and prevent unauthorized removal of its components as well as the problems of inflow in the case of using the manhole cover.

In general, the invention is directed to a manhole frame assembly for supporting the obstructing member when an original level of pavement or other construction material is present as well as when the level of the construction material around the opening is raised. The assembly includes an outer frame member having a support surface and a side wall extending from the support surface. The side wall is constructed and arranged with an upper surface that is substantially flush with an original level of construction material around the access opening. An inner frame member or insert can be received on the support surface and comprises a surface for supporting the obstructing member. The side wall comprises a device for preventing upward movement of the inner frame, especially when the original level of construction material around the access opening is raised. A portion of the inner frame is movable in a direction transverse to a direction of a length of the access opening.

All aspects of the present invention are suitable for modifying original manhole frame assemblies when the level of the roadway is raised. In the event of repaving of the roadway to a higher level, an inner frame member having longer side walls and a higher cover support surface may be selected so that the obstructing member is flush with the repaved roadway.

The terms "manhole frame structure" are used herein to mean a frame or seating receptacle disposed around the access opening. The access hole may be a hand hole, tool hole, "manhole," catch basin or the like. The access hole may be a utility enclosure serving, for example, an electric, gas, water, sewer or storm drainage system.

The manhole frame assembly of the invention may be designed to receive obstructing members that are any shape, including circular, polygonal and orthogonal. For example, circular manhole covers and rectangular drainage grates may be received by the housing of the inner frame. Drainage grates allow water to drain through bars or the like of the grate which separate debris from drainage water.

In a preferred embodiment of the present invention, one of the side wall and the inner frame comprises at least one recessed portion and the other of the side wall and the inner frame comprises at least one protrusion. The side wall is at least partially comprised of an abutment surface that prevents upward movement of the inner frame. The abutment surface is disposed below the upper surface of the side wall and preferably above the ledge. The inner frame preferably comprises the protrusion and the side wall of the outer frame preferably comprises the recess.

The inner frame may be comprised of segments that are expandable to provide greater and more accurate peripheral adjustment in the circumferential contact between the recessed portion and the protrusion. Adjustable members (e.g., turnbuckle joints) enable the segments to be moved, thereby expanding or contracting the peripheral dimensions of the inner frame. The number of inner frame segments is greater than two, with four segments being preferable. When the inner frame is expanded, the protrusions are moved into the recessed portion and contact between the protrusions and the abutment surface prevents lifting of the inner frame from the outer frame. The inner frame may also be comprised of an unsegmented "split ring" having opposing end portions connected by an adjustable member.

In another embodiment, the protrusions comprise fasteners such as threaded bolts. In a preferred aspect of the invention the fasteners are disposed on the inner frame and extend away from the access opening. The fasteners may be moved so as to protrude into the recessed portion. The protrusions may also comprise a combination of protruding surfaces and fasteners disposed on the inner frame. When using the fasteners, the inner frame may either be adjustable or have fixed peripheral dimensions. In the case of the inner frame having fixed dimensions, once the inner frame is received by the outer frame, the fasteners are moved outwardly into the recessed portion to a position where the fasteners can engage the abutment surface to prevent lifting of the inner frame.

An adjustable inner frame using the fasteners may be expanded in its peripheral dimensions once it is received by the outer frame. If the fasteners already protrude outwardly from the inner frame when it is received by the outer frame, expanding the inner frame will move the protrusions directly into the recessed portions to prevent lifting of the inner frame. Alternatively, the fasteners may be positioned so as not to protrude outwardly from the inner frame when the inner frame is first received by the outer frame. After the inner frame is expanded in its peripheral dimensions into contact with the side wall of the outer frame, the fasteners may be advanced so as to protrude into the recessed portion to prevent lifting of the inner frame.

The recessed portion is preferably integrally formed with the side wall of the outer frame. However, the outer frame may be modified in the field to have a recess or opening formed therein which may receive the protrusion of the inner frame to prevent lifting of the inner frame, especially after the roadway surface has been raised. Alternatively, an abutment member or a fastener may be connected to the outer frame. The protrusion of the inner frame would be positioned in a recess formed below the abutment member or fastener.

In a preferred embodiment, it is desirable to fasten the manhole cover or drainage grate, for example, to the inner frame. Movement of the protrusions into the recessed portion and fastening of the cover or grate to the inner frame results in an assembly that may not be lifted or jarred loose. In this regard, an aspect of the invention relates to a manhole assembly including the obstructing member constructed and arranged to be supported on a support surface of a manhole frame structure (e.g., the inner frame). The obstructing member includes openings disposed therein.

The manhole assembly also includes at least one locking device for connecting the obstructing member to such manhole frame structure, each locking device comprises a rotatable locking member comprising a toe portion and a threaded portion defining a hole therein. The toe portion is adapted to engage a portion of the manhole frame structure. The locking device also includes at least one shaft each including a threaded portion. Each shaft is adapted to be located in one of the openings of the obstructing member and is threaded to the locking member. Each shaft includes a device (e.g., a shaft head or recess) enabling rotation of the shaft. Each locking device also preferably includes thermoplastic material disposed between the threaded portion of the locking member and the threaded portion of the shaft. The thermoplastic material creates a resistance to rotation between the shaft and locking member while enabling the shaft to be rotated after the locking member contacts the manhole frame structure. At least one stop surface extends from the obstructing member, each being adapted to stop rotation of the locking member at a predetermined position. Rotation of each shaft causes the locking member to rotate until the toe portion of the locking member is positioned adjacent the abutment surface at a stopping point where the locking member contacts the stop surface. Further rotation of the shaft drives the locking member toward the abutment surface to clamp the obstructing member to such manhole frame structure. The locking device may also include at least one spring carried, for example, by the head of the shaft.

Another aspect of the invention is directed to a method of raising the obstructing member in a manhole frame assembly of the type in which an outer manhole frame is disposed around an access opening and has a side wall with an upper surface that is located at an original level of construction material around the access opening. In such a manhole frame assembly an inner manhole frame can be disposed on a ledge of the outer frame and can support the obstructing member. Conventionally, such method included raising a level of construction material around the access opening, inserting the inner frame into the outer frame and supporting the member for obstructing the access opening at the raised level of the construction material. According to the present invention, an improved method comprises moving a portion of the inner frame in a direction transverse to a direction of a length of the access opening. The inner frame portion is positioned at a location in which it can engage an abutment surface disposed below the upper surface of the side wall and generally above the ledge. Upward movement of the inner frame is prevented by the abutment surface.

In particular, the method includes moving at least one protrusion of the manhole assembly into at least one recessed portion of the manhole assembly. One of the side wall and the inner frame comprises the recessed portion and the other of the side wall and the inner frame comprises the protrusion. Each protrusion may be extended outwardly from the inner frame with respect to the access opening and moved outwardly into the recessed portion. When the protrusions comprise fasteners, the fasteners may be moved outwardly into the recessed portion. This movement of the fasteners is by way of threaded engagement between each fastener and the inner frame. When the inner frame is segmented, the adjustable members may be operated to enable the inner frame to be expanded and contracted in peripheral dimensions. In the case of an inner frame having an unsegmented body, the adjustable member is operated to enable the unsegmented body to be expanded and contracted in peripheral dimensions.

The manhole frame assemblies of the present invention substantially reduce the inflow problems of the prior art in the case where the inner frame supports a manhole cover. The entire inner frame is preferably covered with a sealant material. The seal thus provided between the inner and outer frames prevents inflow from passing therebetween. Also, clamping the cover to the inner frame provides a seal therebetween. In addition to providing seals that overcome the problems of inflow, the locking device may be used to prevent unauthorized personnel from removing the manhole cover.

Water-tight seals may be provided to fit into the space or spaces existing between the openings in the inner frame after installation to prevent inflow from passing through the inner frame segment openings. A molded portion or a portion of an extruded member cut to fit, can be heated or chemically bonded in place to keep the inner frame water-tight. These portions may also identify the placement of the adjustable members.

The present invention addresses the fit between metal surfaces necessary to provide a water-tight condition as a result of production of metal castings by cast iron foundries using sand casting molds. In this regard, the present invention uses natural rubber seals or other like material which compensates for much of the tolerance variations. The invention combines the use of such seals with an expansive force that compressively seals the matching inseam surfaces of the engaged component parts and assemblies that could otherwise allow the entry of stormwater and other street surface liquids into the utility service.

The invention will become better understood from the accompanying drawings and detailed description of the preferred embodiments.

DETAILED DESCRIPTION OF THE PREFERRED EMBODIMENTS

Figure 1:
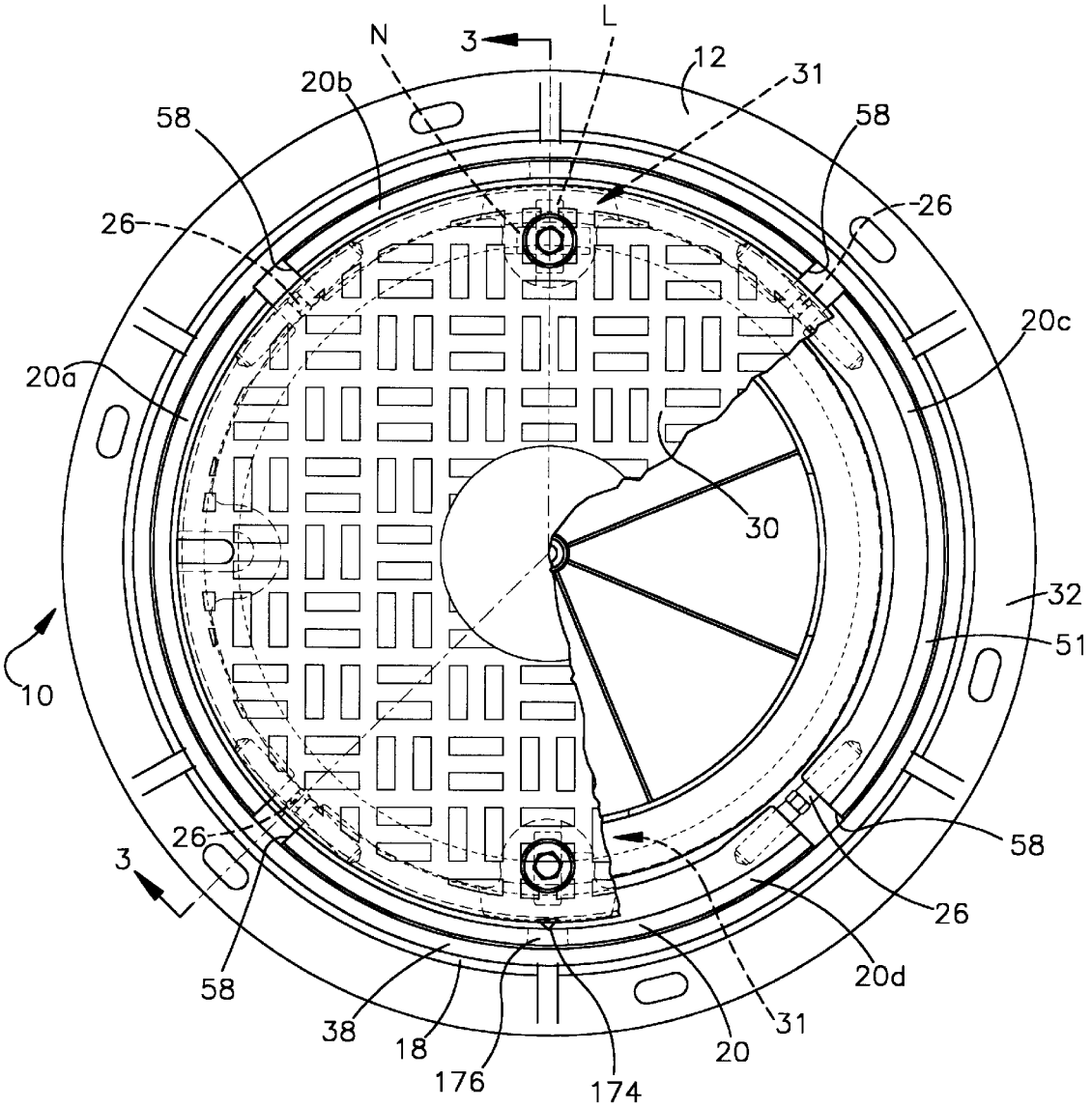
FIG. 1 is a top plan view of a manhole frame assembly constructed in accordance with the present invention.
Figure 2:
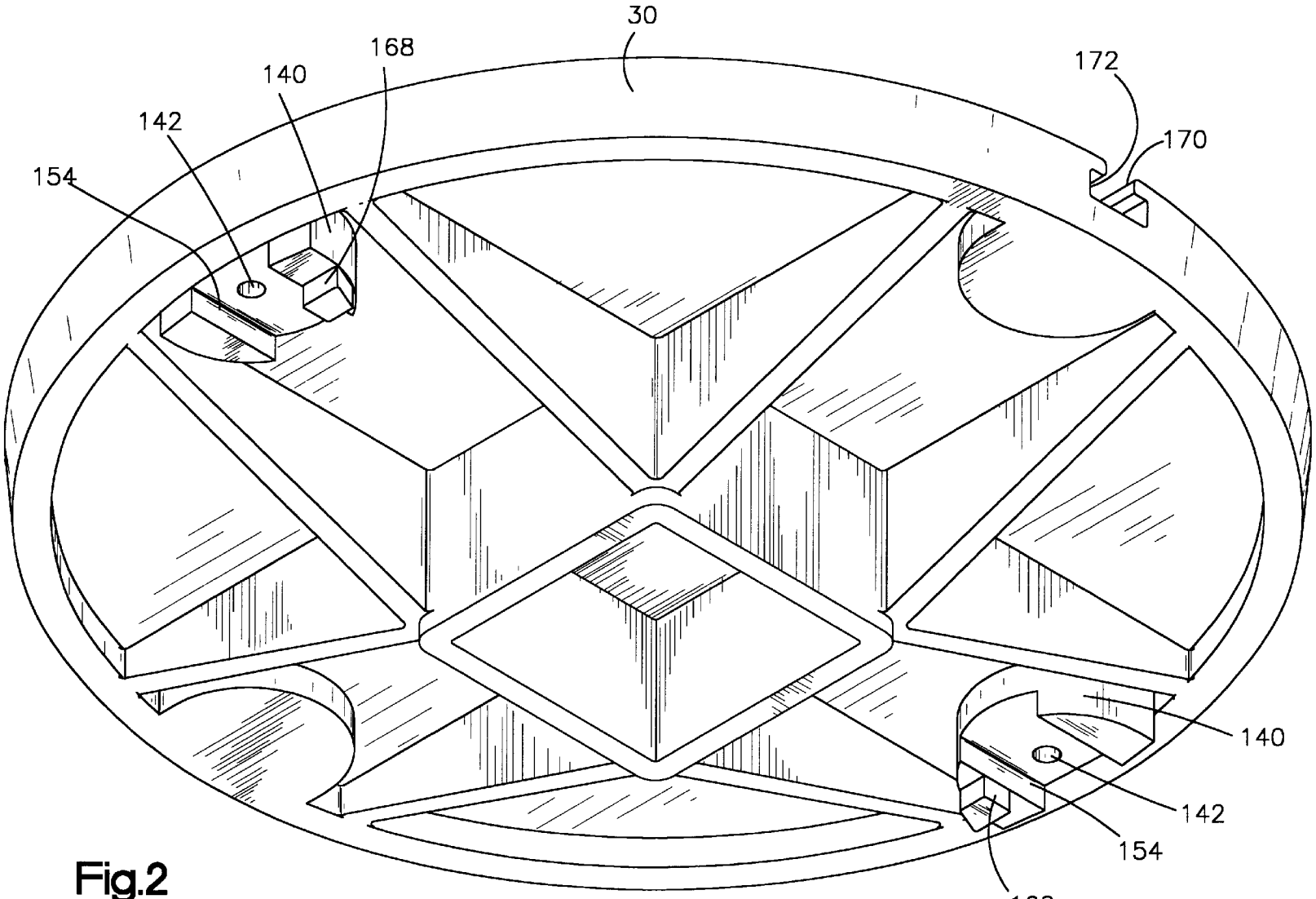
FIG. 2 is a perspective view of the bottom of a manhole cover constructed according to the present invention.

Turning now to FIGS. 1 and 2 of the drawings, a manhole frame assembly constructed according to the invention is shown generally at 10. The manhole frame assembly 10 includes an outer frame member 12 having a support surface 14 and a side wall 16 extending upwardly from the support surface 14. The outer frame 12 is disposed around an access opening 13. The side wall 16 has a recessed portion 18 that is at least partly comprised of an abutment surface 19. An inner frame member 20 is supported on the support surface 14 of the outer frame.

The inner frame 20 includes four segments 20*a*–*d* each having an outer peripheral surface 22 and at least one protrusion 24 extending outwardly from the outer peripheral surface 22. Adjustable members preferably in the form of turnbuckles 26 connect adjacent segments 20*a*–20*d* together for enabling the peripheral dimensions of the inner frame to be adjusted. By adjusting the turnbuckles 26, the inner frame 20 can be expanded to move each protrusion 24 into the recessed portion 18, and contracted to remove each protrusion from the recessed portion. The inner frame 20 also includes a support surface 28 upon which is supported a member 30 for obstructing the access opening.

The member 30 for obstructing the access opening may be a manhole cover, drainage grate or the like. Manhole covers and drainage grates may be constructed in accordance with U.S. standards. Manhole covers may also be constructed in accordance with other standards, such as the Japanese Industrial Standard (JIS) A 5506, Manhole Covers for Sewerage. The obstructing member 30 may be secured to the inner frame by a fastening device 31 such as that described in the Ser. No. 08/515,986 application for which disclosure that application is specifically incorporated by reference herein.

The outer frame 12 has a base portion 32 anchored with fasteners 34 to a manhole casement structure 36 usually formed of concrete that provides access via the access opening to a utility service such as sanitary sewer distribution lines. The outer frames of all manhole frame assemblies of the present invention may have at least one groove 37 at their bottom surface (which is shown only on the left side of FIG. 3 for clarity, but may also be an annular groove that extends completely around the circumference of the outer frame). The groove reduces the weight of the outer frame 12. The groove 37 fits onto at least one protrusion 38 formed on the top surface of the casement structure 36. The protrusion 38 is preferably annular and assists in seating the outer frame onto the casement structure. A sealing gasket 40 formed of rubber, for example, may be disposed between the outer frame and the annular protrusion of the casement structure to provide a fluid seal between the casement structure and the outer frame. The casement structure 36 can be constructed in accordance with U.S. standards, as well as other standards, such as the Japanese Industrial Standard (JIS) A 5317, Reinforced Concrete Manhole Blocks for Sewerage Work.

The support surface 14 of the outer frame 12 is preferably integrally formed with the base 32 and is in the form of a shelf that extends substantially horizontally inwardly from the side wall 16. The side wall 16 extends upwardly from the shelf 14 to an upper rim 42. The side wall is preferably constructed and arranged such that the upper rim 42 is substantially flush with the upper level of the original pavement surface P1.

As a result of fabrication, the side wall 16 of the outer frame 12 may slope slightly upwardly and outwardly from the shelf 14 to the top rim 42. Below the rim 42 the side wall 16 includes the recessed portion 18. The recessed portion 18 preferably extends downwardly with respect to the rim 42 and outwardly with respect to the access opening, to an intersection with the shelf 14. The recessed portion 18 may be formed by cutting an opening into a conventional outer frame side wall that has already been installed. Such a conventional outer frame includes a horizontal ledge but does not include the recessed portion 18. In such a conventional outer frame without the recess 18, shown in dotted lines in FIG. 3, an opening 43 may be cut into the side wall for receiving the protrusion 24. Any of the other features for connecting the inner and outer frames shown in FIGS. 9–12 may also be used in this embodiment instead of the recess 18 and the protrusion 24. However, the side wall 16 is preferably cast with a configuration that forms the recess 18 and is used in conjunction with the protrusion 24.

The angle of an inner peripheral surface 44 of the outer frame at the recessed portion 18 can range from an angle of about 1 degree less than the normal to the shelf 14 to an angle of about 1 degree above the plane of the shelf 14. However, it will be understood from the instant disclosure in all embodiments that the recessed portion and the protrusion can have any configuration such that an abutment surface disposed on or formed integrally with the side wall prevents the inner frame 20 from being lifted from the recessed portion 18.

Figure 3:
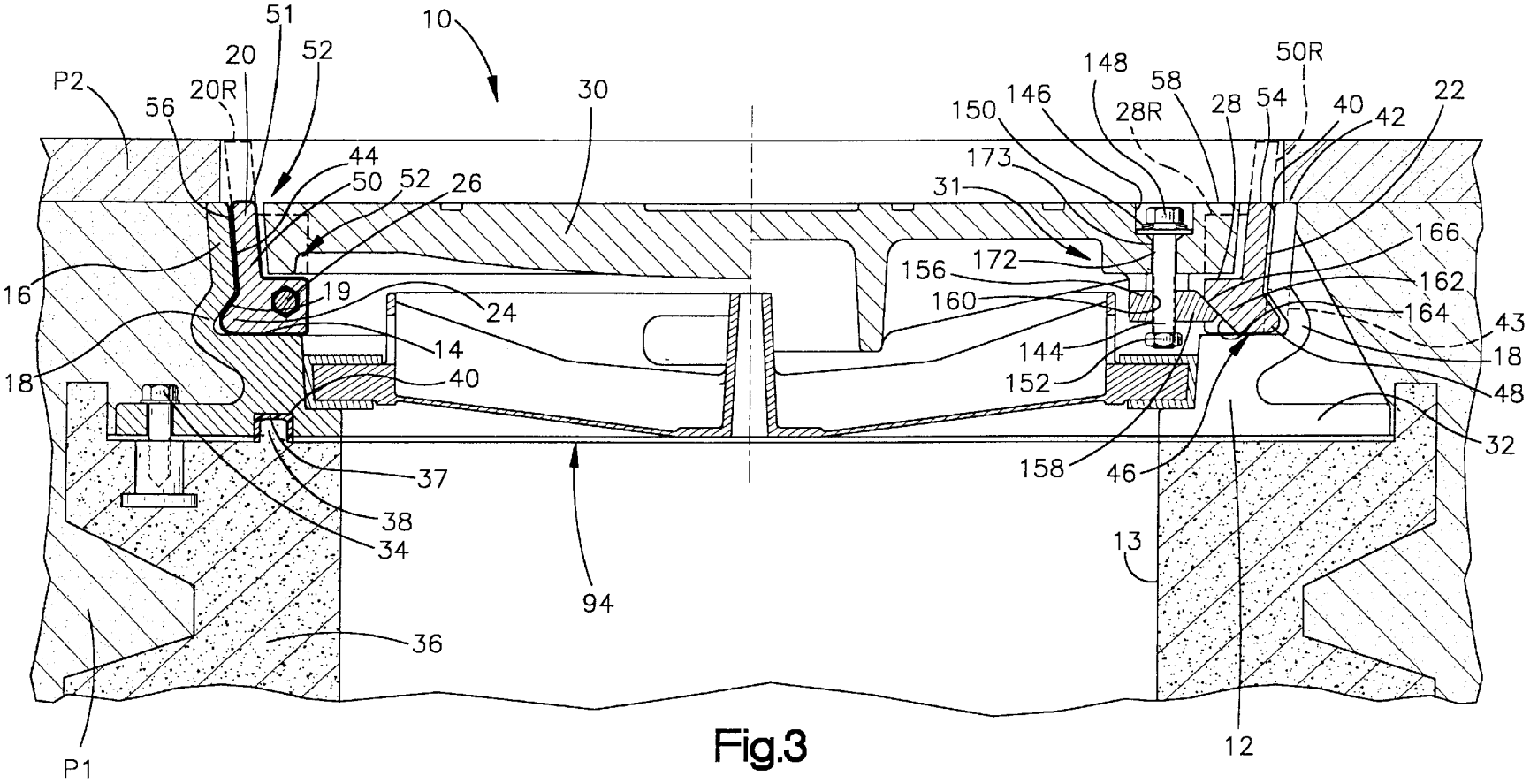
FIG. 3 is a vertical cross-sectional view as seen from the plane taken approximately along the lines 3—3 of FIG. 1, showing the manhole frame assembly in a position in which it is originally installed and a repaved surface $P_2$ added to an original paved surface $P_1$.

As shown in FIGS. 1 and 3, the side wall 16 and the shelf 14 form a housing 46 of the outer frame. The inner frame 20 fits into the housing 46 and is seated on the support surface 14. Each of the adjacent segments, e.g., 20*b* and 20*c*, is connected by an adjustable member such as a turnbuckle 26. Each of the segments 20*a*–20*d* has a base 48 and a side wall 50 extending upwardly from the base 48 to form a housing 52 of the inner frame. A rim 54 is disposed at an upper portion of the frame 20. The side walls 50 may be fabricated to be sloped outwardly from the base 48 to the rim 54. The member 30 shown here as a manhole cover, is placed in the housing 52 and supported on the support surface 28 of the inner frame 20.

Figure 4:
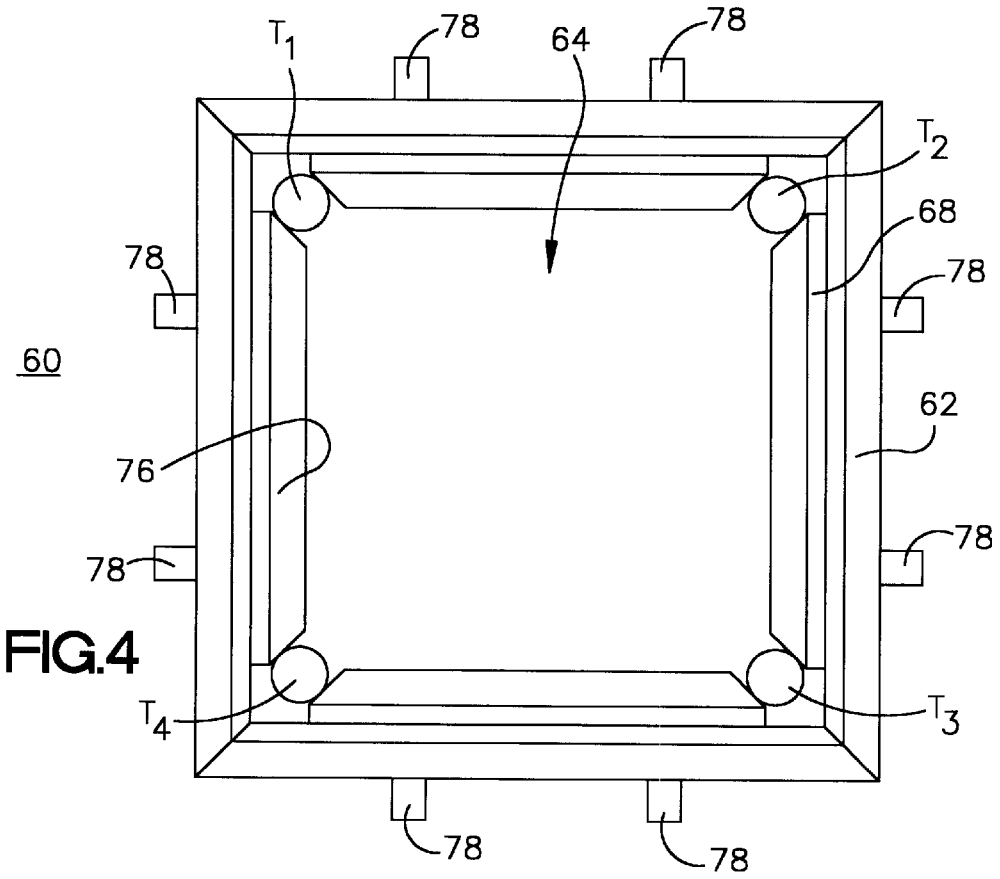
FIG. 4 is a diagrammatic top plan view of another manhole frame assembly constructed according to the present invention.

The housing 46 of the outer frame may have a circular, polygonal or orthogonal shape in all embodiments of the present invention to accommodate an inner frame of corresponding shape. So, too, may the housing 52 of the inner frame have a circular, polygonal or orthogonal shape in all embodiments of the present invention to accommodate the member 30 obstructing the access opening having a corresponding shape. For example, the inner frame may have an opening that is circular to accommodate a circular manhole cover (FIG. 1) or an opening that is rectangular to accommodate a rectangular drainage grate (FIG. 4).

The size of the inner frame is changed by adjusting the turnbuckles 26 to expand or contract the inner frame 20 in the lateral direction. The protrusions 24 are configured and arranged to fit into the recessed portion 18. By adjusting the turnbuckles 26 to expand the inner frame 20, the protrusions 24 are releasably moved into the recessed portion 18 of the outer frame 12. Once the protrusions are positioned in the recessed portion 18, the inner frame is prevented from substantial upward movement and removal from the outer frame.

Referring to FIG. 3, when a roadway is resurfaced, a layer of additional paving material $P_2$ is laid atop the original roadway $P_1$. As a result, the overall level or grade of the roadway is raised. A replacement inner frame insert 20R shown in dotted lines in FIG. 3 replaces the previous insert 20. The replacement insert 20R has a longer side wall 50R and a higher support surface 28R than the previous insert 20 shown in solid lines. The configuration of the replacement insert 20R is selected such that the original manhole cover 30 is substantially flush with the upper surface of the new roadway layer $P_2$. The other features of the replacement insert 20R are the same as discussed above regarding the previous insert 20. Aspects of the construction of the replacement insert, the additional paving material P2, the paving material P1 and the outer frame and casing shown in FIG. 3, are also applicable to all other embodiments of the present invention. Other replacement inserts 20R may be used if the level of the pavement is raised above the level of the layer P2, such inserts having a higher support surface 28R and longer side wall 50R to bring the obstructing member up to the raised level.

A seal 56, shown for illustrative purposes on only the left side of the inner frame 20 in FIG. 3, may be provided between the inner and outer frames 12, 20 of all embodiments of the invention (and especially when a manhole cover is used) to prevent inflow from passing therebetween. Preferably, the entire inner frame 20 is covered with the sealant material to form the seal 56. However, the seal 56 could be provided on portions of the outer frame 12. Any compressible sealant material may be used for the seal 56, although natural rubber is preferred.

A detailed list of materials that may be suitable for the seal 56 as well as for all other seals of the present invention, is provided in U.S. Pat. Nos. 4,969,771 and 4,927,290 to Bowman, which are incorporated herein by reference in their entireties. These materials are preferably selected to withstand the periodic stresses exerted on them when the manhole cover, for example, is rotated on the inner frame 20. It should be noted that some of the materials, such as closed cell foam, may be unable to withstand such periodic stresses.

The inner frame 20 can advantageously be provided with one or more water-tight plugs (not shown) that fit into the space or spaces 58 existing between the segments 20*a*–20*d* of the inner frame 20 after installation. A molded portion or a portion of an extruded member cut to fit, can be heated or chemically bonded in place to keep the inner frame 20 water-tight. These plugs may identify the placement of the turnbuckles 26 and can be molded or otherwise formed to cover the turnbuckles 26.

For a description of these plugs and of the materials from which they can be formed, refer to the U.S. Pat. No. 4,927,290. In particular, the plugs referred to by reference numeral 36 in the U.S. Pat. No. 4,927,290 patent may be used in the present invention. In the invention, the plugs can also be formed of any of the sealant materials referred to in the U.S. Pat. Nos. 4,969,771 and 4927,290 patents.

The manhole frame assembly 10 and the other embodiments of the manhole frame assemblies of the invention, may employ at least one locking device 31 for locking the obstructing member 30 to the inner frame 20. This locking member is referred to by reference numeral 56 in the application Ser. No. 08/517,081, for which disclosure the application Ser. No. 08/517,081 is specifically incorporated herein by reference. The locking member may lock either a manhole cover or a drainage grate to the inner frame in any embodiment of the invention in a manner that would be apparent to those skilled in the art in view of this disclosure.

In addition, the manhole frame assembly of the present invention may employ a device for catching water and preventing it from entering the utility access opening below the outer frame, for example, when a manhole cover is used. One such suitable water catching device is disclosed in the application Ser. No. 08/515,986.

Referring to FIG. 4 of the drawings, another embodiment of the manhole frame assembly of the present invention is shown generally at 60. An outer frame member 62 is constructed and arranged so as to be disposed around an access opening 64 and includes a support surface 66. Extending upwardly from the support surface 66 is a side wall 67. An inner frame member 68 is received on the support surface 66 of the outer frame. The side wall of the outer frame includes a recessed portion 70 comprised in part by an abutment surface 72. The inner frame 68 includes at least one protrusion 74 that extends outwardly with respect to the access opening. The inner frame may be adjustable in its peripheral dimensions to move the protrusions into and from the recessed portions.

Figure 5:
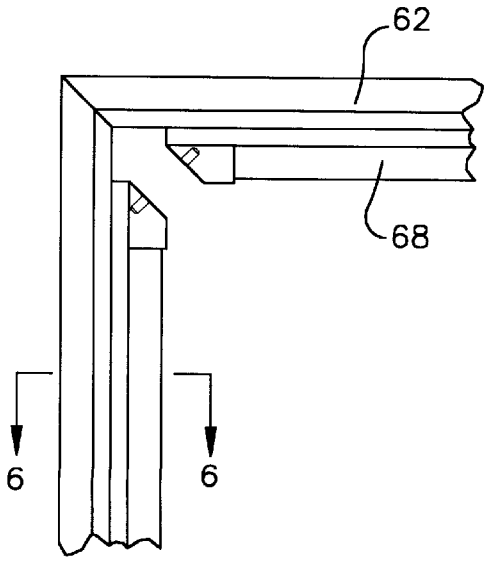
FIG. 5 is a fragmentary top plan view of one corner of the manhole structure shown in FIG. 4 (with adjustable member omitted)
Figure 6:
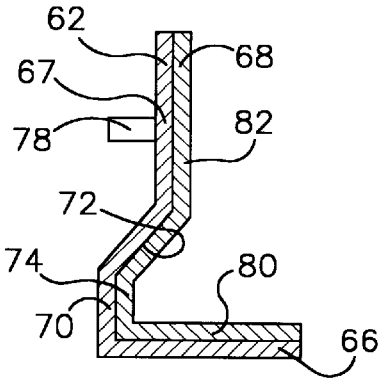
FIG. 6 is a cross-sectional view as seen along the plane designated by the lines and arrows 6—6 in FIG. 5.

In the assembly of FIGS. 4–6 the inner frame preferably includes an orthogonal housing 76 for receiving the member 30 for obstructing the access opening. The obstructing member 30 may be a drainage grate rather than a manhole cover, although both manhole covers and drainage grates may be used in all embodiments of the manhole frame assemblies of the present invention.

The inner frame includes portions having opposing ends connected with spreadable, turnbuckle-equipped joints $T_1$, $T_2$, $T_3$ and $T_4$. The structure and operation of these turnbuckle joints are shown and described in U.S. Pat. No. 4,867,600 and in the application Ser. No. 08/515,986 for which disclosure these documents are specifically incorporated herein by reference. The inner frame fits slidably into the outer frame. The joints $T_1$, $T_2$, $T_3$ and $T_4$ and the inner and outer frames are preferably made of ⅜-inch thick COR-TEN A® brand steel, a registered trademark of USX Corporation. The inner and outer frames may be formed by any method such as by welding, roll forming or casting.

Optional pavement-engagement bosses 78 project from the side wall portions 67 of the outer frame 62. The obstructing member 30 is a separate drainage grate (not shown), which is supported by a support surface 80 of the inner frame 68 and is retained laterally by wall portions 82 of the inner frame. One drainage grate that is suitable for use in the present invention is shown and described in the publication, "ADJUS-TO-GRADE® WITH SAFE-TITE® SEAL NUPCO® Bringing You Up to New Levels," Copyright 1989, which is incorporated herein by reference in its entirety. The outer frame 62 is preferably set into the pavement material P1 and is fastened to the casement structure 36.

Figure 7:
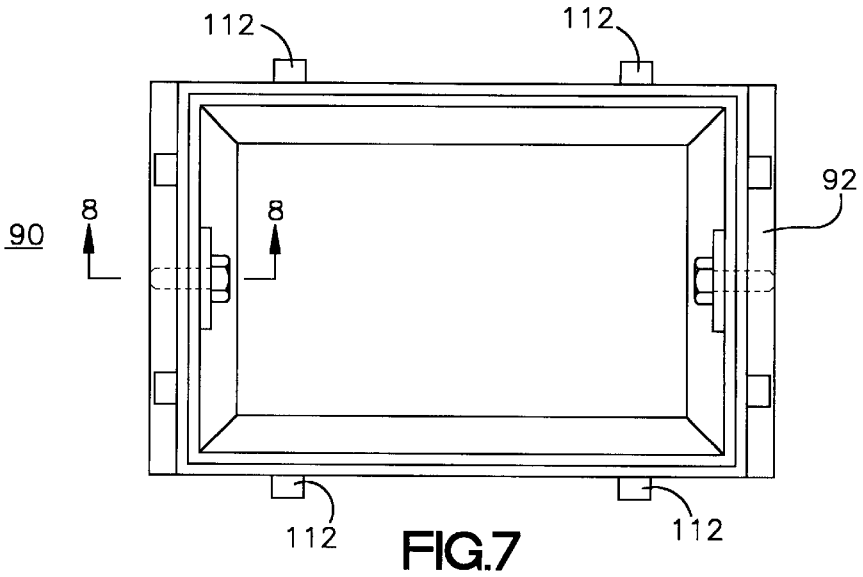
FIG. 7 is a top plan view showing another embodiment of a manhole frame assembly constructed according to the present invention.

Referring to FIG. 7, another embodiment of a manhole frame assembly of the present invention is shown generally at 90. The manhole frame comprises an outer frame member 92 that includes a support surface 94. The support surface 94 of the outer frame is in the form of an inwardly extending, substantially horizontal ledge. The outer frame includes a side wall 96 extending upwardly from the support surface 94. The side wall of the outer frame includes a recessed portion 98 that is comprised in part by an abutment surface 100. An inner frame member 102 rests on the support surface 94 of the outer frame. The inner frame includes at least one protrusion 104 for engaging the abutment surface 100. Each protrusion 104 is preferably in the form of a threaded fastener such as a bolt having a head portion 106 and a threaded portion 108. Locking patches made of a thermoplastic material such as nylon (not shown) may be used on the bolts 104. An optional washer 110 in the form of a lock washer, for example, may also be used. When the fastener is advanced outwardly from the inner frame into a position in which it can engage the abutment surface 100, it prevents the inner frame from being lifted from the outer frame. Optional pavement-engaging bosses 112 extend from the side wall 96 of the outer frame. The outer frame is set into concrete (not shown) such as the pavement P1 at the edge of a roadway, and may be fastened to the casement structure 36 shown in FIG. 3.

One or more bolts may be used at each end of the inner frame as shown in FIG. 7. Alternatively, one end of the inner frame may include at least one bolt and the other end may include a protrusion (such as the protrusion 74 shown in FIG. 6) which would replace the threaded bolt at that end. In such case, the inner frame would be preferably fairly shallow and shorter than the inside length of the outer frame so that the inner frame may be tilted slightly away from the outer frame to disengage the protrusion from the recess in the outer frame.

Although in FIG. 7 the inner frame is shown as an unsegmented member employing the movable threaded fasteners, the inner frame may also be segmented and include adjustable members for adjusting its peripheral dimensions, in the manner of the adjustable manhole frames shown in the other embodiments of the invention. Such an arrangement may employ an adjustable inner frame and use threaded bolts as the protrusions. In operation, the adjustable inner frame may be outwardly expanded into engagement with the side wall 96, and then the bolts may be advanced into the recessed portion to a position where they can engage the abutment surface. Alternatively, the bolts may already be advanced so as to protrude outwardly from the inner frame, so that once the inner frame is received by the outer frame, expanding the inner frame member using the adjustable members positions the bolts into position in the recessed portion.

The overall height of the outer frame 92 may be about 2½ inches, for example. The outer drainage frames may be about 1–3 feet wide and 6 feet long, for example. Ledges of the inner frame support a separately-removable drainage grate 93. Optionally, the grate can be fastened to the inside of the inner frame, as by welding (not shown).

Figure 9:
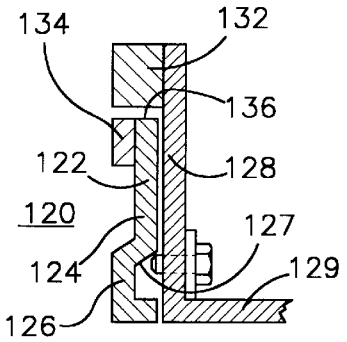
FIGS. 9–12 are cross-sectional views of other embodiments of the manhole frame assembly constructed according to the present invention.

Another embodiment of the present invention is shown generally at 120 in FIG. 9. An outer frame member 122 includes a side wall 124 that includes a recessed portion 126. The recessed portion is at least partly comprised by an abutment surface 127. An inner frame member 128 engages the outer frame. The inner frame 128 includes a support surface 129 for supporting the obstructing member 30. The inner and outer frames include reinforcing members 132, 134, respectively. Instead of the inner frame resting upon the lower ledge of the outer frame as in FIG. 7, the reinforcing member 332 of the inner frame rests on an upper rim 136 and on the reinforcing member 134 of the outer frame. The rim 136 and reinforcing member 134 form a surface for supporting the inner frame. The manhole assemblies of all embodiments of the invention may employ the reinforcing members 132, 134 rather than the lower ledge of the outer frame. The pavement material P1 is preferably disposed around the outer frame and the outer frame is fastened to the casement structure 36.

Figure 10:
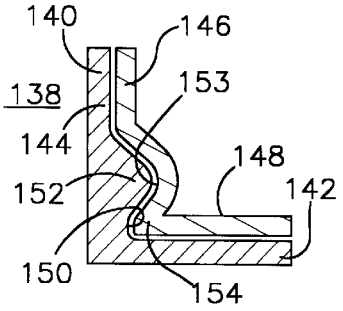
Figure 11:
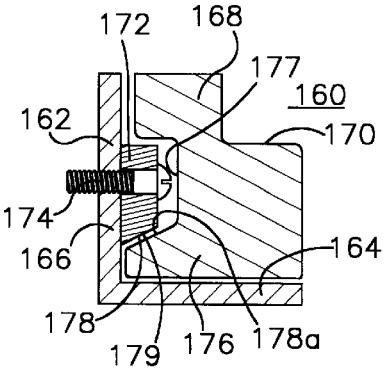
Figure 12:
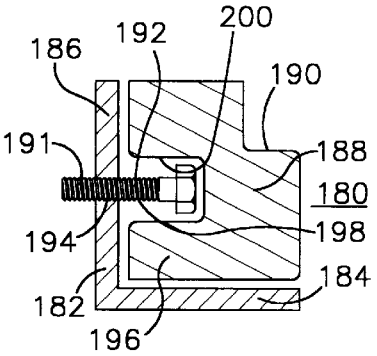

Other arrangements for engaging the inner and outer frames are shown in FIGS. 10–12. In FIG. 10, a manhole frame assembly 138 includes an outer frame member 140. The outer frame includes a support surface 142 and a side wall 144 extending upwardly from the support surface 142. An inner frame member 146 has a surface 148 for supporting the obstructing member 30. In this embodiment, the outer frame has a recessed portion 150 formed by an inwardly protruding portion 152 of the side wall. The inner frame may include a recessed portion 153 for accommodating the protruding portion 152. The inner frame includes at least one outwardly extending protrusion 154 that can be moved, via the adjustable members, into the recessed portion 150. In all embodiments of the invention, the protrusions preferably extend around the entire circumference of the inner frame as shown in FIG. 1. The recessed portion 150 is at least partly comprised of an abutment surface 154 on its underside, which prevents substantial upward movement of the inner frame.

A manhole frame assembly 160 of FIG. 11 includes an outer frame 162 having a support surface 164 and a side wall 166 extending upwardly from the support surface. An inner frame member 168 includes a surface 170 for supporting the obstructing member 30 when there is a raised level of surrounding pavement P2. The surface 170 may also be lower when only the pavement P1 is present. The inner and outer frames are connected together by fastening a lug 172 to the outer frame using a fastener 174. The inner frame includes at least one protrusion 176 that can be moved via the adjustable members, below the lug 172. The inner frame may include a recessed portion 177 for receiving the lug. The lug is at least partly comprised by an abutment surface 179. The abutment surface 179 and the protrusion may each have opposing surfaces 178, 178a with a bevel at the same angle for mating contact, as can the corresponding elements in all embodiments of the present invention. The abutment surface 179 prevents substantial upward movement of the inner frame.

A manhole assembly 180 shown in FIG. 12 includes an outer frame member 182 having a support surface 184 and a side wall 186 extending upwardly from the support surface. An inner frame member 188 includes a surface 190 for supporting the obstructing member 30 when there is a raised level of surrounding pavement P2. The surface 190 may also be lower when only the pavement layer P1 is present. In this embodiment, a threaded fastener 191 is threaded to a threaded opening 194 drilled into the side wall of the outer frame. The inner frame includes a protrusion 196 that may be moved via the adjustable members, below the fastener 191 to a position where lifting of the inner frame is prevented. The fastener is at least partly comprised of an abutment surface 198 that prevents substantial upward movement of the inner frame. The inner frame may include a recessed portion 200 for receiving the head of the fastener.

The inner and outer frames of the present invention may be formed of any suitable material. Examples of suitable suitable materials for the inner and outer frames include cast ductile iron such as ASTM type 536, grade 65-45-12, A.I.S.I. grade A588 steel, 606-type 4 steel, COR-TEN A® brand steel, and galvanized or plain mild steel. Other steels and other ferrous metals such as cast malleable iron, can also be used. The side walls and support surfaces of the inner and outer frames are preferably integrally formed together.

The installation of the inner frames of FIGS. 1–6 and 10–12 will now be described generally by reference to FIGS. 1–3. It would be appreciated that the inner frames of FIGS. 4–6 may be modified to mount the locking devices 31 to the drainage grate in the manner shown and described in the application Ser. No. 08/517,081, particularly FIG. 7 of that application, for which disclosure the application Ser. No. 08/517,081 is specifically incorporated herein by reference. Further, the inner frame 68 (FIG. 6) may be modified to include a surface corresponding to the undercut portions 162 in a manner that would be appreciated by those skilled in the art.

The inner frame 20 fits into the housing 46 and is seated on the support surface 14. The diameter of the opening defined by the inner surface of the side walls of the inner frame is adjustable by adjusting the turnbuckles 26 to expand or contract the inner frame 20 in the lateral direction. By adjusting the turnbuckles 26 to expand the inner frame 20, the protrusion 24 of the inner frame 20 are releasably moved into engagement with the recessed portion 18 of the outer frame 12. Once the protrusions 24 are positioned in the recessed portion 18, the inner frame 20 is prevented from substantial upward movement and removal from the access opening 42.

In the case of the arrangements shown in FIGS. 10–12, the fasteners 174 and 191 are threaded to the threaded opening formed in the outer frame. The fastener 174 secures the locking member 172 to the outer frame. Movement of the inner frame causes the protrusions 154, 176 and 196 to move into the corresponding recessed portions of the outer frame.

Each of the locking devices 31 is preferably of the type disclosed in U.S. application Ser. No. 08/517,081, which is incorporated herein by reference in its entirety. Although two locking devices are shown in FIG. 1, more locking devices may be used. Each locking device 31 includes a housing 140 integrally formed with or otherwise fastened to the cover 30 or drainage grate and has a threaded portion defining a vertical bore 142. A threaded bolt 144 is inserted into each bore 142 with sufficient clearance to permit the bolt to rotate. A recess 146 is formed at the top of each cover to accommodate heads 148 of the bolts. A lock washer or Belleville-type spring disk 150 is placed between the head 148 of each bolt and the surface forming the bottom of the recess 146 to resist loosening of the bolt once it is tightened. A nut 152 may be provided at the bottom of the bolt. Radially extending slots 154 are formed at the bottom of the housing 140, as shown in FIG. 2.

As shown in FIG. 3, each locking device 31 has a locking member 156 with a toe portion 158 and a threaded portion defining a bore 160 therethrough. The bore 160 is sized to receive the threaded shaft of the bolt. At least two of the segments, e.g., 20*b* and 20*d*, have undercut portions 162 as best shown in FIG. 3. Each locking member 156 is configured and arranged to fit into one of these undercut portions upon being rotated, and to engage the inner frame. The top of each of the undercut portions has an outwardly sloping surface 164 relative to the access opening. The toe portions of each locking member are each beveled to have an outwardly sloping surface 166 that corresponds to the slope of the associated undercut sloping surface 164.

A portion of the locking member is arranged to be able to engage a stop member 168 that is adjacent the slot 154. The housings 140 not only provide stop surfaces for the locking members, but also serve to protect the threads of the bolts and the locking members themselves from damage caused by pry bars and other tools used around manholes.

A patch of thermoplastic material 173, a portion of which is generally shown on the left side of the bolt in FIG. 3, is applied to the threaded portion of each bolt to increase the friction between the bolt threads and the locking member 156. One suitable thermoplastic material is a nylon material which is commercially available from ND Industries. The thermoplastic material is preferably sprayed on the bolt threads as a liquid which later dries to a solid. The thermoplastic material 173 is preferably disposed substantially completely around the circumference of the bolt for substantially the entire length of the bolt. The thermoplastic material helps ensure that rotation of the bolt will rotate the locking member 156 until the locking member 156 is in the proper position to be tightened against the inner frame. Too little friction between these parts could result in the tightening of the locking members before they are outwardly rotated beneath the undercut portions 162.

Alternatively, each locking member 156 may have the thermoplastic material disposed along its threaded opening 160 rather than along the bolt. However, it may be more difficult to apply the thermoplastic material in the opening 160 rather than on the shaft of the bolt.

The locking members are rotated to a neutral position N so that they will not interfere with seating of the cover 30. Then, the cover 30 is aligned with the access opening. The cover 30 has diametrically opposed openings 170 each leading to a groove 172. A tool such as a spanner wrench is inserted through the openings 170 in the cover 30 into the grooves 172. Using the tool, the cover 30 is rested on the cover support surface 28 and rotated until an indicator mark 174 on the cover 30 is aligned with an indicator mark 176 on the rim 54 of the inner frame. This indicates that the cover is in a proper circumferential position to align each of the locking devices with an associated undercut portion 162 of the inner frame. A drainage grate may also include marks indicating the location of the Locking devices, but indicating marks may not be needed when using a grate since workers can see the locking member location through the grate.

If each locking member is in its inner neutral position N, rotation of the bolt in a clockwise direction (in FIG. 1) will cause each toe portion 158 to rotate along with the bolt, due to the resistance of the thermoplastic material, clockwise into its locking position L. In the locking position L the locking member is engaged in the undercut portion 162. The locking member will not be permitted to rotate further when it engages the stop member 168.

Further rotation of the bolt in the clockwise direction will cause the locking member to overcome the resistance of the thermoplastic material and to move axially upward along the bolt in the slot 154 due to the relative configurations of the threads formed on the outside of the bolt and along the bore in the housing. During this time, the slot maintains the locking member in the locking position L. Tightening of the bolt eventually causes the surfaces 166, 164 of the locking member and undercut portions, respectively, to contact each other. This locks the obstructing member 30 to the inner frame.

By rotating the bolt in the opposite direction (counterclockwise as viewed in FIG. 1) when the obstructing member 30 is locked to the inner frame, the locking members move downwardly along the bolts within the slots until they are free from the inner frame. Without the frictional drag of engagement with the inner frame and once the locking member is lowered out of the slot, rotating the bolt (counterclockwise as viewed in FIG. 1) causes the toe portion of the locking member to rotate inwardly along with the bolt, due to the resistance of the thermoplastic material, until it has again reached the neutral position N. The locking member advantageously engages the stop member in both the locking position L and neutral position N.

Figure 8:
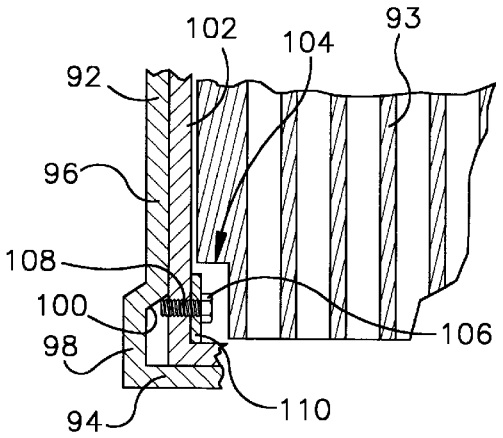
FIG. 8 is a cross-sectional view as seen along the plane designated by the lines and arrows 8—8 in FIG. 7 with a drainage grate in place.

The installation of the inner frame and obstructing member 30 will now be generally described for the assemblies shown in FIGS. 7–9. The inner frame is lowered into the outer frame. If a horizontal support surface of the outer frame is used (e.g., surface 94), the inner frame rests on this surface. If reinforcing members are used instead (e.g., reinforcing members 132, 134), the inner frame reinforcing member rests on the upper rim and reinforcing member of the outer frame.

After the inner frame has been positioned in the outer frame, the fasteners are preferably turned so as to protrude outwardly into the recessed portion of the outer frame to a position where they can engage the abutment surface when an upward force is exerted on the inner frame. The manhole cover or the drainage grate (e.g., grate 93) can be secured to the inner frame using the locking devices 31 in the manner described above. In the case of the inner frame including adjustable members (e.g., turnbuckles) and fastening devices (e.g., locking members 31), the installation proceeds as described above with respect to FIGS. 1–3.

While preferred embodiments of this invention have been described in detail, it will be apparent that certain modifications or alterations can be made without departing from the spirit and scope of the invention set forth in the appended claims.

What is claimed is:

1. A manhole frame assembly for supporting a member that can obstruct an access opening when an upper surface of construction material around the opening is raised, said manhole frame assembly comprising:

an outer frame member disposed around the access opening having a support surface and a side wall extending from said support surface, said side wall being constructed and arranged with an upper surface that is substantially flush with an original level of the construction material;

an inner frame member that can be supported on said support surface, said inner frame member comprising a surface for supporting the member for obstructing the access opening;

said side wall comprising abutment means for preventing upward movement of said inner frame member when the original level of construction material around said outer frame member is raised, wherein a portion of said inner frame member is movable in a direction transverse to a direction of a length of the access opening.

2. The manhole frame assembly of claim 1 wherein one of said side wall and said inner frame member comprises at least one recessed portion and the other of said side wall and said inner frame member comprises at least one protrusion.

3. The manhole frame assembly of claim 2 wherein said side wall comprises said at least one recessed portion and said inner frame member comprises said at least one protrusion.

4. The manhole frame assembly of claim 2 wherein each said protrusion comprises a fastener that can be moved into and from said recessed portion.

5. The manhole frame assembly of claim 4 wherein each said fastener comprises threads and engages a threaded opening of said inner frame member.

6. The manhole frame assembly of claim 2 comprising an abutment member fastened to said outer frame member to form said recessed portion below said abutment member, wherein said inner frame member comprises said at least one protrusion which can engage an underside of said abutment member.

7. The manhole frame assembly of claim 1 wherein said inner frame member comprises a segmented body and at least one adjustable member that enables segments of said body to be expanded and contracted in peripheral dimensions.

8. The manhole frame assembly of claim 1 wherein said inner frame member comprises an unsegmented body and an adjustable member that enables said body to be expanded and contracted in peripheral dimensions.

9. The manhole frame assembly of claim 1 further comprising a drainage grate that obstructs the access opening.

10. The manhole frame assembly of claim 1 further comprising a manhole cover that obstructs the access opening.

11. The manhole frame assembly of claim 1 wherein said inner frame member forms a housing for receiving the member for obstructing the access opening, said housing having a shape selected from the group consisting of polygonal, orthogonal and circular.

12. The manhole frame assembly of claim 1 wherein said abutment means comprises a surface of said side wall that extends downwardly with respect to said upper surface of said side wall and outwardly with respect to the access opening.

13. The manhole frame assembly of claim 1 further comprising a seal between said inner frame member and said outer frame member.

14. The manhole frame assembly of claim 1 wherein said outer frame member has a lower surface that can contact a casement structure and a groove formed in the lower surface, further comprising a sealing material disposed in said groove.

15. The manhole frame assembly of claim 1 further comprising a support structure having an upper surface on which said outer frame member is disposed, wherein at least one upstanding protrusion extends from said upper surface of said support structure for engaging said outer frame member.

16. A manhole frame assembly for supporting a member that can obstruct an access opening when an upper surface of construction material around the opening is raised, comprising:

an outer frame member and an inner frame member that can be received by said outer frame member, said outer frame member having a support surface and a side wall that extends from the support surface, said side wall comprising an abutment surface that prevents upward movement of said inner frame member, said side wall being constructed and arranged with an upper surface that is substantially flush with an original level of the construction material; and said inner frame member being supportable on said support surface and including (a) at least one protrusion extending from an outer peripheral surface thereof, (b) at least one adjustable joint adapted to adjust said inner frame member in its peripheral dimensions to expand to move said protrusion into a position in which it can engage said abutment surface, and to contract to remove said protrusion from said position, and (c) a surface for supporting a member that can obstruct the access opening.

17. The manhole frame assembly of claim 16 further comprising a drainage grate supported by said surface of paragraph (c).

18. In a method of raising a member for obstructing an access opening in a manhole frame assembly of the type in which an outer manhole frame is disposed around the access opening and has a side wall with an upper surface that is located at an original level of construction material disposed around the outer frame, wherein an inner manhole frame can be disposed on a ledge of the outer frame and can support the member for obstructing the access opening, such method including raising a level of construction material around the access opening, inserting the inner frame into the outer frame, and supporting the member for obstructing the access opening at the raised level of the construction material, the improvement comprising a method comprising the steps of: moving a portion of said inner frame in a direction transverse to a direction of a length of the access opening; positioning said inner frame portion at a location in which it can engage an abutment surface disposed below the upper surface of said side wall and generally above the ledge of said outer frame; and preventing upward movement of said inner frame portion with said abutment surface.

19. The improvement of claim 18 comprising moving at least one protrusion of the manhole assembly into at least one recessed portion of the manhole assembly, wherein one of said inner frame and the side wall of said outer frame comprises said at least one recessed portion and the other of said inner frame and the side wall comprises said at least one protrusion.

20. The improvement of claim 19 comprising moving at least one fastener disposed on said inner frame outwardly into said at least one recessed portion formed by said outer frame.

21. The improvement of claim 20 wherein each said fastener is moved by way of threaded engagement between said fastener and said inner frame.

22. The improvement of claim 18 wherein at least one member each disposed between segments of said inner frame is adjusted to expand and contract said inner frame in peripheral dimensions.

23. The improvement of claim 18 wherein a member is adjusted to expand and contract an unsegmented body of said inner frame in peripheral dimensions.

24. The improvement of claim 18 wherein said at least one protrusion of said inner frame is moved outwardly into said at least one recessed portion formed by said side wall.

25. A manhole assembly for use when an upper surface of construction material around an access opening is raised, said manhole frame assembly comprising:

an outer frame member disposed around the access opening having a support surface and a side wall extending from said support surface, said side wall being constructed and arranged with an upper surface that is substantially flush with an original level of the construction material;

an inner frame member that can be supported on said support surface, said inner frame member comprising a support surface;

said side wall comprising abutment means for preventing upward movement of said inner frame member when the original level of construction material around said outer frame member is raised, wherein a portion of said inner frame member is movable in a direction transverse to a direction of a length of the access opening;

a member for obstructing the utility access opening constructed and arranged to be supported on said support surface of said inner frame member, said obstructing member including openings disposed therein, and an apparatus for connecting said obstructing member to said inner frame member, comprising (a) at least one rotatable locking member each comprising a toe portion and a threaded portion defining a hole therein, said toe portion being adapted to engage said inner frame member, (b) at least one shaft each including a threaded portion, wherein each said shaft is adapted to be located in one of said openings of said obstructing member and is threaded to an associated said locking member, each said shaft including means for enabling rotation of said shaft, (c) thermoplastic material disposed between the threaded portion of each said locking member and the threaded portion of an associated said shaft, wherein said thermoplastic material creates a resistance to rotation between said shaft and said locking member while enabling said shaft to be rotated after said locking member contacts said inner frame member, and (d) at least one stop surface extending from said obstructing member each being adapted to stop rotation of said locking members at a predetermined position;

whereby rotation of said shaft causes said locking member to rotate until said toe portion of said locking member is positioned adjacent said inner frame member at a stopping point where said locking member contacts said stop surface, and further rotation of said shaft drives said locking member toward said obstructing member to clamp said obstructing member to said inner frame member.

26. The manhole assembly of claim 25 further comprising at least one spring each carried by said means for enabling rotation of said shaft.

* * * * *